United States Patent [19]

Tylko

[11] 4,177,060

[45] Dec. 4, 1979

[54] REDUCTION OF STABLE OXIDES

[75] Inventor: Józef K. Tylko, Faringdon, England

[73] Assignee: Tetronics Research & Development Company Limited, Faringdon, England

[21] Appl. No.: 826,695

[22] Filed: Aug. 22, 1977

[30] Foreign Application Priority Data

Aug. 23, 1976 [GB] United Kingdom ..... 35076/76

[51] Int. Cl.[2] ..... C22B 21/02

[52] U.S. Cl. ..... 75/10 R; 75/68 A

[58] Field of Search ..... 75/10 R, 68 A

[56] References Cited

U.S. PATENT DOCUMENTS 4,033,757 7/1977 Kibby ..... 75/68 A

*Primary Examiner*—M. J. Andrews

*Attorney, Agent, or Firm*—Dennison, Dennison, Meserole & Pollack

[57] ABSTRACT

In a process for the carbothermal reduction of alumina, carbon and alumina are supplied to a molten reaction bed in a hearth in the floor of a reactor. The reaction bed is supplied with energy by contact with plasma or with plasma effluents. For this purpose the reaction bed itself may form the counter-electrode for a plasma gun orbiting about the vertical axis of the reactor or there may be an intermediate counter-electrode. In either case the hearth is preferably electroconductive to provide a current path from the material in the reaction bed. Some or all of the feed material entering the reaction bed may enter the upper end of the reactor and descend through the plasma. At least part of the carbon may be in the form of coarse lumps which are fed to the reactor via an entry duct in counter-current relation to evolved carbon monoxide which preheats and partially scrubs it.

9 Claims, 3 Drawing Figures

REDUCTION OF STABLE OXIDES

This invention relates to the reduction of stable oxides and in particualar to the production of aluminium metal from alumina by a carbothermal route carried out by the utilisation of plasma generating devices.

The reaction of alumina with carbon is highly endothermic and can only proceed at temperatures in excess of about 1950° C. A continuous supply of externally generated energy is therefore essential to maintain the reaction.

Carbothermal reduction of alumina has been extensively studied but while aluminium alloys with for instance silicon have been successfully produced, attempts at reducing pure alumina by the carbothermal route proved possible but commercially unattractive. For instance it has already been proposed to produce aluminium by the direct reduction of alumina in an electric furnace, in which an arc is struck between a plurality of vertical electrodes and a stripped bed of molten metal, to which carbon and alumina in preselected proportions are fed and the gaseous reaction products of the reduction reaction are vented.

In that process a mixture of aluminium and aluminium carbide was formed on the floor of the furnace. However it was found practicable to separate these components from one another after removal from the furnace, the separated aluminium carbide being added to the furnace charge and returned to the system.

The above process, in spite of its apparent advantages, did not compete successfully with the well established Hall-Heroult electrolytic process, presumably because of the very high consumption and cost of the electrodes and other factors such as arc control under the specific conditions created.

In contrast to the above process for carbothermal reduction of alumina in an electric furnace, the present invention creates and maintains conditions under which it is possible to carry out the above reduction without the disadvantages of previous attempts.

According to a first feature of the invention the energy to support the reaction is introduced into a reaction bed containing alumina and carbon by contacting the surface of the reaction bed with plasma or high temperature plasma effluents derived from a plasma gun.

The efficient heating of the reaction bed in this way may be conveniently achieved by means of an orbiting plasma gun in the manner described in U.S. Pat. No. 28,570.

In addition to transfer of energy to the reaction bed by contact with plasma or plasma effluents a further amount of thermal energy may be conveniently introduced into the reaction bed by maintaining a current flow through it. Although the bed is composed primarily of alumina, experiment has shown that at the very high temperature of the process, the bed is electrically conductive in spite of the addition of relatively cold feed materials.

The feed materials or at least a portion of the feed materials are introduced into the reaction bed through the plasma or plasma-derived effluents. Thus, it is particularly convenient to entrain the fine particulate material such as alumina with or without carbon fines, in the plasma where it may acquire not only high temperature but also other desirable electronic and electric properties, while making-up the total carbon requirement by feeding via a side-chute which also serves for venting the gaseous reaction products. Preferably the carbon feed to the side chute is in the form of coarse lumps of such size, e.g. about 2 cms, as to allow easy passage of a rapid gas stream through a column of such lumps. This carbon feed may then be employed to condense Al vapour and $Al_2O$, which react with the carbon and are thus returned to the reaction bed with this coarse carbon feed.

In the accompanying drawings:

FIG. 1 shows diagrammatically a plasma reactor comprising an enclosed reaction chamber defined by thermal insulation within a shell 1.

Figure 1:
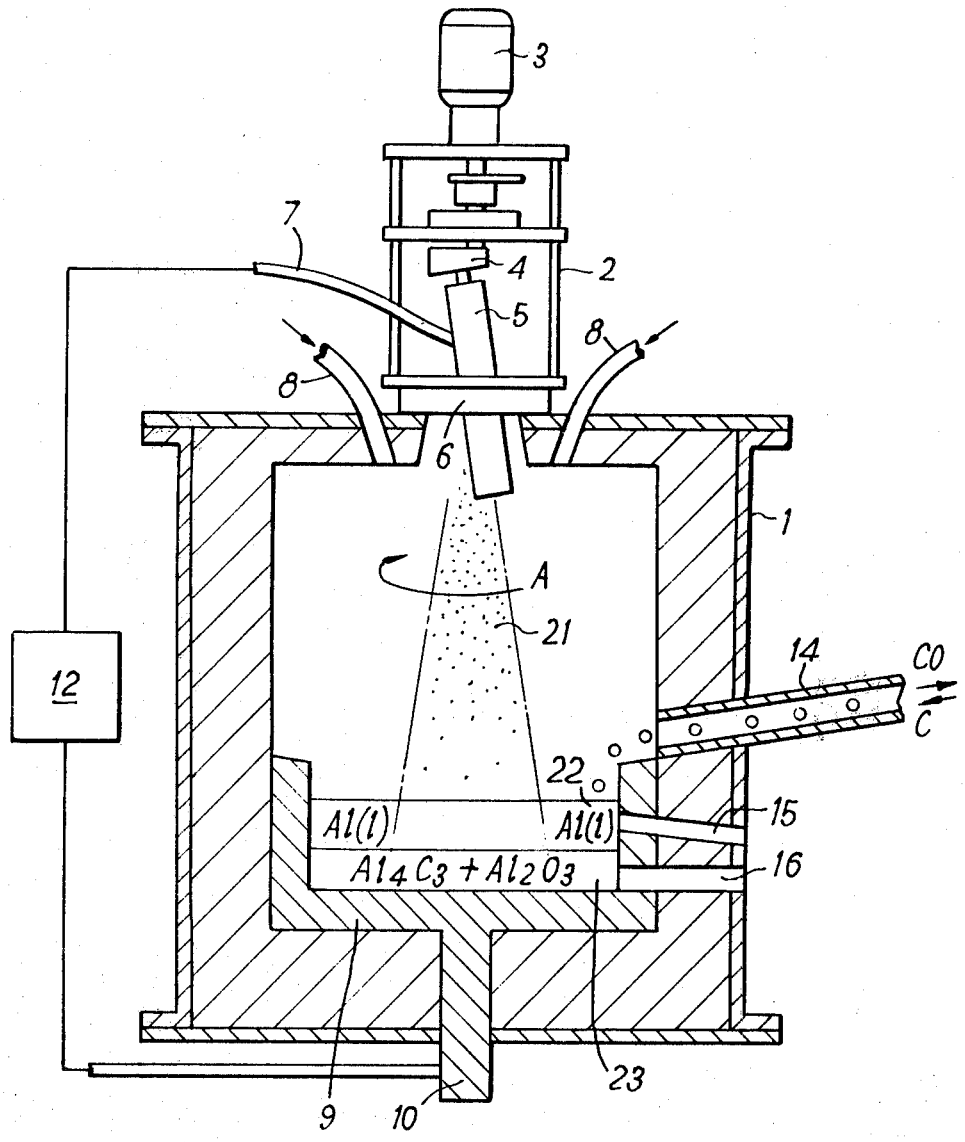
FIG. 1 is a diagrammatic vertical section of one form of plasma reactor for performing the process of the invention.

On the top of the shell there is located a support structure 2, which carries a fluid motor 3 which is connected by a crank drive 4 to a plasma gun 5, supported by a ball joint in a base member 6 of the structure 2. Rotation of the motor 3 thus serves to move the lower end of the plasma gun 5 about the vertical axis of the reactor. During this movement the vertical axis of the plasma gun is inclined to the axis of the reactor and there is no rotation of the plasma gun about its axis, so that connection of the hoses (not shown) for supply of gas and coolant to the plasma gun and the electrical supply cable 7 for the plasma gun cause no problems.

A series of inlet ducts 8, usually six to twelve in number, surround the plasma gun 5 and are supplied with finely divided feed material from a supply hopper, as more fully described in copending patent application Ser. No. 826,697, filed Aug. 22, 1979. The particulate feed material is preferably a prereduction feed material obtained by heating a hydrated or partially hydrated alumina with a hydrocarbon as described in copending patent application Ser. No. 826,696, filed Aug. 22, 1977 and is blown towards the reactor axis under gas pressure.

In the lower part of the reactor there is provided a hearth structure 9, which is at least in part electrically conductive and connected to one or more heavy gauge conductor rods 10, which provide a return path to a power source 12 for the plasma gun. The hearth structure 9 thus forms a counterelectrode for the plasma gun 5. For start-up purposes a levermounted shoe or vertically movable shoe is provided for transferring the plasma column from the plasma gun 5 (then stationary) to the counter-electrode provided by the hearth structure or (a body of metal supported by the hearth structure) as more fully described in copending patent application Ser. No. 826,697.

In the lower part of the reactor one or more gas escape ducts 14 are provided and these may be filled with a column of coarse carbon briquettes which move counter-current to the gas stream and are fed into the hearth structure 9 at predetermined rate. A product outlet duct 15 and a "bottom solids" outlet duct 16 are also provided.

In operating the apparatus of FIG. 1 it is usually preferable to establish an initial molten layer of aluminium metal in direct contact with the hearth structure 9. A plasma column is then transferred from the plasma gun 5 to the molten metal layer established on the hearth structure as mentioned above. The motor 3 is then started to produce orbital movement of the plasma gun so that there is then a precessing movement of the plasma column in the reaction chamber i.e. within the space indicated at 21. Feed material is then fed in through ducts 8. Such feed material preferably comprises a finely divided alumina material, prepared in accordance with the method of copending patent application Ser. No. 826,696. with supplemental carbon feed via chute 14. In many cases however the whole of the required carbon may enter the reaction chamber with the feed material.

As the operation proceeds a layer of liquid Al, containing dissolved $Al_4C_3$, will form as an upper layer 22 on a lower layer 23 composed of $Al_4C_3$ and $Al_2O_3$. These layers are scarcely distinct from one another as a result of the rapid evolution of gas from the charge on the hearth.

In their descent through the reaction chamber the feed material particles are caused to obtain a horizontal velocity by reason of the circulatory precessing movement of the plasma in the direction of the arrow A and this results in the presence of a cloud of particles in the region around the upper part of the plasma column 1 which acts as a radiation shield between the plasma and the thermal insulation.

The circulatory movement imparted by the precessing plasma assists in the coalescence of the small metal droplets formed as a result of the reaction set up in the feed particles through contact with the plasma.

Figure 2:
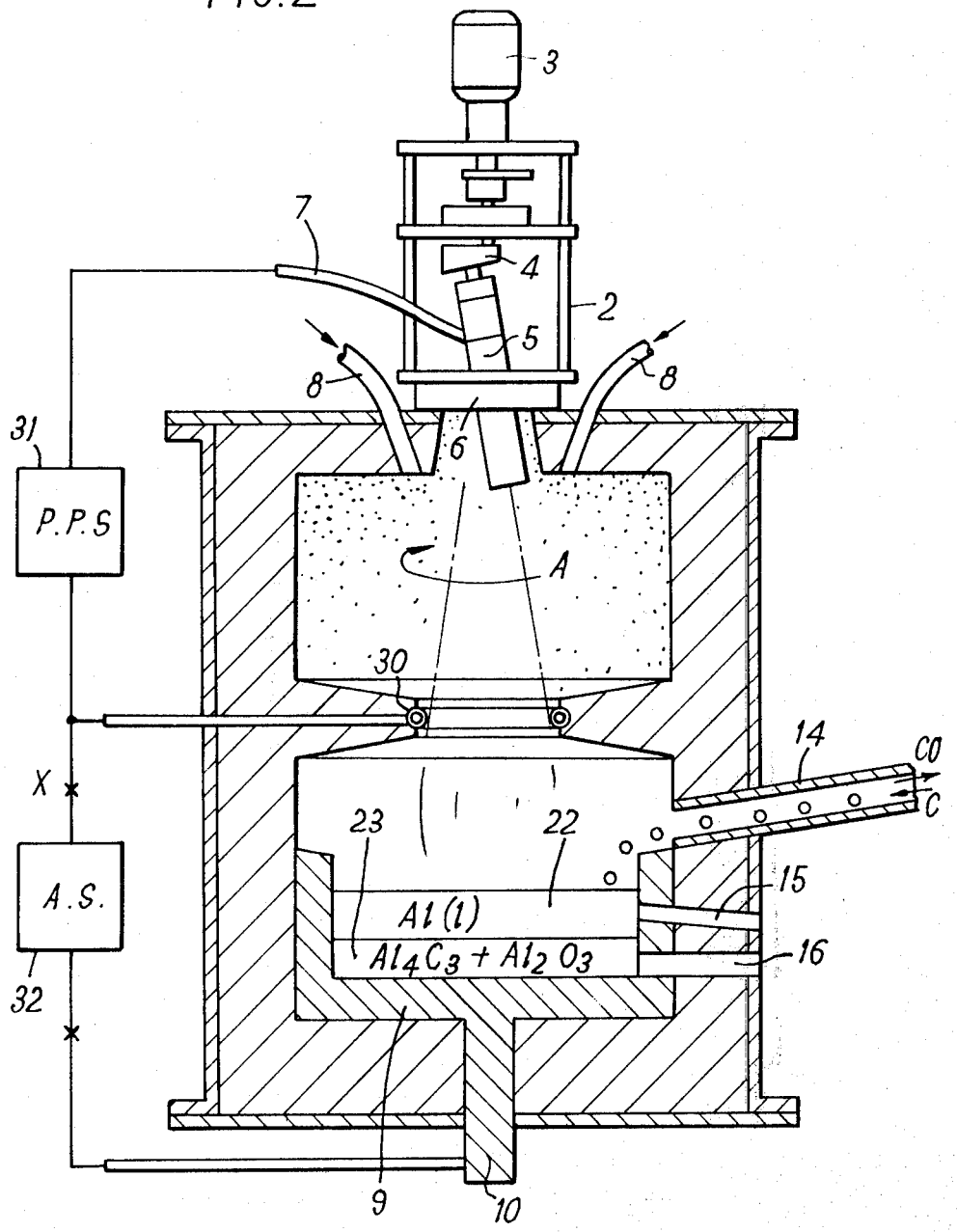
FIG. 2 is a similar section of a modified form of the reactor of FIG. 1.

In the modified form of apparatus illustrated in FIG. 2 the reference numerals have the same significance as in FIG. 1. In this modified apparatus the plasma column is set up between the plasma gun 5 and a ring-shaped counterelectrode 30. A principal power source 31 is connected between the counter-electrode 30 and the plasma gun 6 and an additional power source 32 is connected between points X and Y. The additional power source 32 may be A.C. or D.C. and is intended to introduce extra thermal energy into the material on the hearth structure 9. The circuit for the power source is completed, between the counter-electrode 30 and the Al-$Al_4C_3$ layer 22, through the plasma effluents which issue downwardly through the counter-electrode 30.

Figure 3:
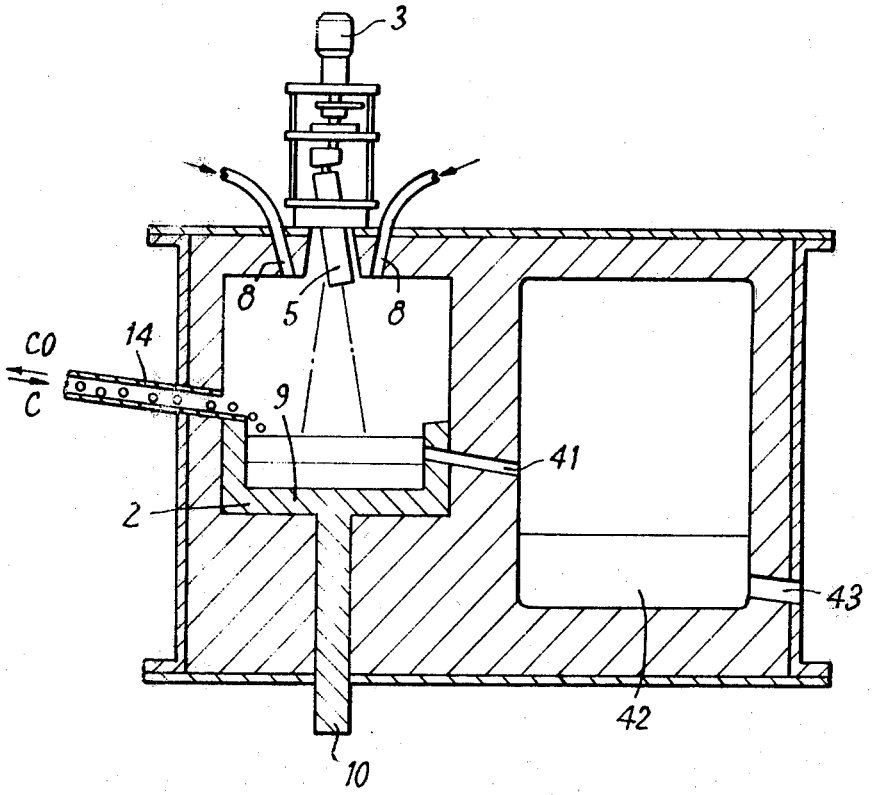
FIG. 3 is a diagrammatic section of a reactor with auxiliary apparatus for collection of product.

In FIG. 3 there is shown an apparatus according to FIG. 1, combined with a tapping vessel 42 to which a body of metal is admitted from the reaction chamber by duct 41 to allow separation of the metal from $Al_4C_3$. Al metal may be tapped off from the heavier $Al_4C_3$ deposited in vessel 42 via a further duct 43.

The above arrangements are given by way of examples only. The advantages of the invention are chiefly due to three factors, namely:

1. the complete dispensing with conventional graphite electrodes as used in arc furnaces (the ring-shaped counter-electrode may very conveniently be made from graphite),
2. the ability to scale-up to industrial size chiefly by virtue of the reliance on the precessing plasma column to provide the necessary energy for the reduction of alumina, and
3. the ability to control accurately and maintain an energy transfer through the reaction bed, particularly where the apparatus of FIG. 2 is employed and the output of the supply 32 can be controlled in relation to the output of the supply 31.

EXAMPLE

In a typical carbothermal reduction of alumina approximately 170 kg. of feedstocks containing 122 Kg. of alumina and 48 kg. of carbon were introduced as circular curtain of fines ($<240\mu$) falling uniformly at a rate varying between 48–50 g/sec. into a plasma cone formed by a plasma gun orbiting about a point on its longitudinal axis and inclined at 9° to the vertical. The orbital speed of approximately 1850 rpm. was maintained throughout the experiment which lasted 1 hour. An additional ½ kg. of aluminium dust was also dispensed into the reaction vessel throughout the experiment. The power to plasma was maintained at approximately 240 kw. Upon separating the products at approximately 700° C., 51.4 kg. of aluminium metal and 12.1 kg. of aluminium carbide was obtained. The plasma gun was fed with 900 liters of argon. The above example was carried out in an apparatus substantially as shown in FIG. 2.

In FIG. 1 up to 80% or even more of the added carbon may be added via the side chute. It is always preferred to feed at least 20% and even up to 120% of the stoichiometric quantity of carbon required for the reduction of the alumina in the feed material entering at the top of the reaction chamber so as to promote reduction of the alumina particles in the plasma. However the reaction of alumina with carbon or the carbon content of $Al_4C_3$ continues in the bottom hearth as a result of direct exposure to plasma in FIG. 1 or to plasma effluents, coupled with direct electric resistance heating in FIG. 2.

It will be understood that for thermal efficiency it is desirable to take up the surplus sensible heat of the gas issuing from the gas ducts to the maximum extent by heat exchange with the feed materials. Thus where the exhaust gas is employed to preheat the coarse carbon lumps fed in through the duct 14 it may subsequently be employed to preheat the alumina feed to a lesser extent. Alternatively where all the feed material is supplied to the top end of the reactor chamber this material may be preheated by the exhaust gas and held in the feed hopper at a temperature of, for example, 700° C.

In both cases the particulate feed material may be preheated by allowing it to fall through an ascending stream of the exhaust gases in a vertical or steeply inclined column.

It will of course also be understood that all $Al_4C_3$ separated from the product aluminium tapped off via duct 15 will be returned to the reaction bed either with coke entering via duct 14 or with the feed material entering the reactor via the ducts 8.

I claim:

1. A process for the carbothermal reduction of alumina comprises supplying a feed of alumina and carbon to a molten reaction bed maintained in a reaction chamber, exhausting evolved gases from said reaction chamber and supplying energy to said reaction bed by contacting said bed with plasma or plasma effluents derived from at least one plasma gun orbiting about the vertical axis of the reaction chamber and generating plasma within an essentially conoidal zone within said reaction chamber.

2. A process according to claim 1 in which at least part of the feed to the reaction bed is contacted by plasma in the conoidal plasma zone before entering the reaction bed.

3. A process according to claim 1 further comprising feeding alumina in finely divided form into the upper end of the reaction chamber and directing said alumina into the conoidal plasma zone.

4. A process according to claim 3 in which the alumina feed is supplied to the reaction chamber at multiple positions around the axis of the reaction chamber.

5. A process according to claim 3 in which the finely divided alumina is in intimate admixture with finely divided carbon in an amount of at least 20% of the stoichiometric quantity required to reduce the alumina.

6. A process according to claim 5 in which up to 80% of the carbon feed to the reaction bed is in the form of coarse lumps and is preheated by contact with the evolved gases before entry into the reaction chamber.

7. A process according to claim 1 further comprising establishing a plasma column between said orbiting plasma gun and a counter-electrode formed by a conductive layer of material on an electrically conductive hearth structure at the bottom of said reaction chamber.

8. A process for the carbothermal reduction of alumina which comprises supplying a feed of alumina and carbon to a molten reaction bed maintained in a reaction chamber, exhausting evolved gases from said reaction chamber and supplying energy to said reaction bed by contacting said bed with plasma or plasma effluents derived from at least one plasma gun orbiting about the vertical axis of the reaction chamber and generating plasma within an essentially conoidal zone within said reaction chamber and further comprising establishing a plasma column between said orbiting plasma gun and a horizontal ring-shaped counter-electrode arranged above the reaction bed in said reaction chamber and further establishing an electrical power source between said counter-electrode and an electrically conductive hearth structure supporting said reaction bed whereby to introduce additional energy into said reaction bed.

9. A process according to claim 1 further including preheating feed material by contact with the evolved gas and subsequently feeding such material into the upper end of the reaction chamber.

* * * * *